US009583812B2

(12) United States Patent
Gao

(10) Patent No.: US 9,583,812 B2
(45) Date of Patent: Feb. 28, 2017

(54) THIN, FLEXIBLE TRANSMISSION LINE FOR BAND-PASS SIGNALS

(71) Applicant: Multi-Fineline Electronix, Inc., Irvine, CA (US)

(72) Inventor: Qiang Gao, Tucson, AZ (US)

(73) Assignee: MULTI-FINELINE ELECTRONIX, INC., Irvine, CA (US)

( * ) Notice: Subject to any disclaimer, the term of this patent is extended or adjusted under 35 U.S.C. 154(b) by 0 days.

(21) Appl. No.: 15/009,569

(22) Filed: Jan. 28, 2016

(65) Prior Publication Data

US 2016/0149285 A1 May 26, 2016

Related U.S. Application Data

(63) Continuation of application No. PCT/US2014/048498, filed on Jul. 28, 2014.

(Continued)

(51) Int. Cl.
*H01P 1/203* (2006.01)
*H01P 7/08* (2006.01)

(Continued)

(52) U.S. Cl.
CPC ..... *H01P 7/082* (2013.01); *H01P 1/203* (2013.01); *H01P 1/20381* (2013.01);

(Continued)

(58) Field of Classification Search
CPC ..... H01P 1/20372; H01P 1/20381; H01P 1/20354; H01P 7/086; H01P 7/082; H01P 7/08; H01P 1/203; H01P 7/10; H01P 3/081

(Continued)

(56) References Cited

U.S. PATENT DOCUMENTS 5,982,256 A 11/1999 Uchimura et al.
6,674,347 B1 1/2004 Maruhashi et al.

(Continued)

FOREIGN PATENT DOCUMENTS

CN 101471479 A 7/2009
CN 102 013 537 A 4/2011
KR 1020120050317 A 5/2012

OTHER PUBLICATIONS

International Search Report and Written Opinion in International Application No. PCT/US2014/048498, mailed Nov. 11, 2014 in 11 pages.

(Continued)

*Primary Examiner* — Stephen E Jones
*Assistant Examiner* — Rakesh Patel
(74) *Attorney, Agent, or Firm* — Knobbe Martens Olson & Bear, LLP

(57) ABSTRACT

A signal transmission line includes a signal conductor and an array of resonators. The resonators can include split resonators. The array of resonators can partially overlap with the signal conductor of the signal transmission line. In some embodiments, the portion of the signal conductor overlapping with the split ring resonators is wider than the portion of the signal conductor outside the overlapping area. The signal transmission line can be tuned for a range of frequencies. For example, the signal transmission line can be tuned to have an absolute value of a s-parameter less than or equal to 1 dB for a range of frequencies. The signal transmission line can be less than or equal to 200 microns in thickness and may also be flexible.

22 Claims, 8 Drawing Sheets

Related U.S. Application Data

(60) Provisional application No. 61/859,600, filed on Jul. 29, 2013.

(51) Int. Cl.
*H01P 7/10* (2006.01)
*H01P 3/08* (2006.01)

(52) U.S. Cl.
CPC ..... *H01P 3/081* (2013.01); *H01P 7/10* (2013.01); *H01P 7/086* (2013.01)

(58) Field of Classification Search
USPC ..... 333/204, 205, 219, 235
See application file for complete search history.

(56) References Cited

U.S. PATENT DOCUMENTS 7,619,495 B2 11/2009 Albacete et al.
7,795,995 B2 * 9/2010 White ..... H01L 23/552 333/134
8,461,943 B2 6/2013 Kato
2005/0242905 A1 * 11/2005 Inoue ..... H01P 1/2039 333/204
2007/0024399 A1 * 2/2007 Martin Antolin ..... H01P 1/2013 333/205
2007/0262834 A1 * 11/2007 Albacete ..... H01P 1/20381 333/204
2009/0009853 A1 1/2009 Tonucci
2012/0184231 A1 7/2012 Cheng et al.
2012/0194399 A1 8/2012 Bily et al.

OTHER PUBLICATIONS

Saha, et al. "Square split ring resonator backed coplanar waveguide for filter applications," URSI General Assembly and Scientific Symposium, 2011, IEEE, 4 pages.

Ali A et al, "Metamaterial Resonator Based Wave Propagation Notch for Ultrawideband Filter Applications," IEEE Antennas and Wireless Propagation Letters, IEEE, vol. 7, Jan. 1, 2008 pp. 210-212.

European Search Report in EP Application No. 14832974.1 dated Jul. 7, 2016 in 9 pages.

* cited by examiner

THIN, FLEXIBLE TRANSMISSION LINE FOR BAND-PASS SIGNALS

CROSS-REFERENCE TO RELATED APPLICATIONS

This application claims the benefit under 35 U.S.C. §120 and 35 U.S.C. §365(c) as a continuation of International Application No. PCT/US2014/048498, designating the United States, with an international filing date of Jul. 28, 2014, titled "THIN, FLEXIBLE TRANSMISSION LINE FOR BAND-PASS SIGNALS," which claims the benefit of U.S. Provisional Patent Application No. 61/859,600, filed Jul. 29, 2013, titled "THIN, FLEXIBLE TRANSMISSION LINE FOR BAND-PASS SIGNALS." The entirety of each of the above-mentioned applications is hereby incorporated by reference herein and made a part of this disclosure.

BACKGROUND

Transmission lines may generally be designed to carry, for example, alternating current or radio frequency signals. One of the most common types of transmission line is a coaxial cable. Transmission lines are commonly used in mobile devices (e.g., phones) to transmit a signal from a controller circuit to one or more antenna circuits in a mobile telephone. As a result, the signal transmission line may be configured to transmit signals with a wide range of frequencies. For example, signal transmission line can be configured to carry signals for a Bluetooth antenna, a Wi-Fi antenna, or a mobile communications antenna operating at various frequencies. While robust, coaxial cables can be too bulky for use in mobile devices. Another type of signal transmission line is a stripline signal transmission line. In the stripline structure, a signal line can be sandwiched between an upper and a lower grounding conductor with an insulating material disposed between the conductors and the signal line. The insulating material of a substrate can form the dielectric. The width of the signal line, the thickness of the substrate, and the relative permittivity of the substrate can determine the characteristic impedance of the stripline structure. There remains a need for improvements to signal transmission lines, especially for use in mobile devices.

SUMMARY

Certain aspects, advantages and novel features of the embodiments of this disclosure are described herein. It is to be understood that not necessarily all such advantages may be achieved in accordance with any particular embodiment disclosed herein. Thus, the disclosed embodiments may be implemented in a manner that achieves or selects one advantage or group of advantages as taught herein without necessarily achieving other advantages as may be taught or suggested herein.

In certain embodiments, a signal transmission line can include a signal conductor. The signal transmission line can further include a first array of split ring resonators positioned on a first side of an x-z plane that intersects a longitudinal axis of the signal conductor, wherein the x-z plane splits the signal conductor into a first side and a second side, wherein the x-z plane is substantially perpendicular to the signal conductor. Further, the signal transmission line can include a second array of split ring resonators positioned on a side opposite from the first side of the x-z plane. In some embodiments, the first array of split ring resonators partially overlaps with the first side of the signal conductor. Further, in some embodiments, the second array of split ring resonators partially overlaps with the second side of the signal conductor. The first array of split ring resonators and the second array of split ring resonators can be positioned in a x-y plane that is substantially parallel to the signal conductor.

The signal transmission line of the preceding paragraph can have any sub-combination of the following features: a dielectric material separating the signal conductor and the first array and the second array of split ring resonators; a first grounding conductor substantially coplanar with the first and the second arrays of split ring resonators; a second grounding conductor substantially coplanar with the signal conductor; a third grounding conductor substantially parallel to the signal conductor; a plurality of vias configured to electrically connect the first, second, and third grounding conductors; wherein the first array of split ring resonators is symmetrical to the second array of split ring resonators with respect to the x-z plane; wherein a thickness of the signal transmission line is less than or equal to 200 microns; wherein a width of the signal transmission line greater than or equal to 10 times a thickness of the signal transmission line; wherein an absolute value of an s-parameter of the signal transmission line is less than or equal to 1 dB for a first range of frequencies; wherein a first width of the signal conductor overlapping the first array of split ring resonators is greater than a second width of the signal conductor not overlapping the first array of split ring resonators; and wherein the split ring resonators comprise rectangular split ring resonators.

In certain embodiments, a signal transmission line can include an array of split ring resonators. The signal transmission line can also include a signal conductor including a first side of the signal conductor that is inside an area overlapping with the array of split ring resonators and a second side of the signal conductor that outside the area overlapping with the array of split ring resonators. The signal transmission line can further include an assembly body comprising dielectric material that provides a support structure for at least the split ring resonators and the signal conductor. In some embodiments, a first width of the first side of the signal conductor is greater than or equal to three times a second width of the second side of the signal conductor.

The signal transmission line of the preceding paragraph can have any sub-combination of the following features: wherein the array of split ring resonators is positioned on a non-intersecting plane with the signal conductor; wherein the array of split ring resonators partially overlaps with the signal conductor; a dielectric material separating the signal conductor and the array of split ring resonators; a first grounding conductor substantially coplanar with the array of split ring resonators; a second grounding conductor substantially coplanar with the signal conductor; a third grounding conductor substantially parallel to the signal conductor; a plurality of vias configured to electrically connect the first, second, and third grounding conductors; wherein the thickness of the signal transmission line is less than or equal to 200 microns; wherein a width of the signal transmission line greater than or equal to 10 times a thickness of the signal transmission line; wherein an absolute value of an s-parameter of the signal transmission line is less than or equal to 1 dB for a range of frequencies comprising a range of 4 GHz to 7 GHz.

In certain embodiments, a signal transmission line can include a signal conductor configured to carry signals of a first range of frequencies. The signal transmission line can also include a first array of split ring resonators partially overlapping the signal conductor. Further, the signal transmission line can include a second array of split ring resonators partially overlapping the signal conductor. In some embodiments, an absolute value of a s-parameter of the signal transmission line is less than or equal to 1 dB for the first range of frequencies.

The signal transmission line of the preceding paragraph can have any sub-combination of the following features: wherein the first range of frequencies comprise greater than or equal to 4 GHz and less than or equal to 7 GHz; wherein the first array of split ring resonators is symmetrical to the second array of split ring resonators with respect to a x-z plane that intersects along a longitudinal axis of the signal conductor; a dielectric material separating the signal conductor and the first and the second arrays of split ring resonators; a first grounding conductor substantially coplanar with the first and the second arrays of split ring resonators; a second grounding conductor substantially coplanar with the signal conductor; a third grounding conductor substantially parallel to the signal conductor; a plurality of vias configured to electrically connect the first, second, and third grounding conductors; and wherein the signal transmission line is flexible.

BRIEF DESCRIPTION OF DRAWINGS

Embodiments disclosed herein are described below with reference to the drawings. Throughout the drawings, reference numbers are re-used to indicate correspondence between referenced elements. The drawings are provided to illustrate embodiments described herein and not to limit the scope of the claims.

DETAILED DESCRIPTION

This disclosure describes embodiments of signal transmission lines that can be used in electronic devices such as, for example, mobile telephones, for connecting two circuits to each other. For example, a signal transmission line can be used to transmit a signal from a controller circuit to one or more antenna circuits in a mobile telephone. As a result, the signal transmission line may be configured to transmit signals with a wide range of frequencies. For example, a signal transmission line can be configured to carry signals for a Bluetooth antenna, a Wi-Fi antenna, or a mobile communications antenna operating at various frequencies. In some embodiments, the signal transmission line is flexible and/or made from a material system comprising flexible materials.

In some embodiments, the signal transmission line has a low insertion loss. For example, the signal transmission line can have an insertion loss less than or equal to about 1 dB over a relevant pass band. In some embodiments, a transmission line has constant characteristic impedance. Accordingly, the trace width of a transmission line can be determined from the geometry of the transmission line. To improve the flexibility of the signal transmission line, a thickness of a dielectric substrate (e.g., a signal line body or support structure) can be less than or equal to about 200 microns. The trace width of the transmission line may also be reduced for a thinner substrate in order to maintain the characteristic impedance. However, reducing the trace width of the transmission line may increase resistance of the transmission line and increase insertion loss. Some of the embodiments described below may overcome one or more of the limitations described above of a broadband transmission line carrying a bandpass signal used in mobile communication protocols. In some embodiments, the transmission line is tuned to reduce losses in the range of less than or equal to 10 GHz and/or greater than or equal to 2.5 GHz. The transmission line can be tuned based on the structural parameters discussed below.

Signal Transmission Line

Figure 1:
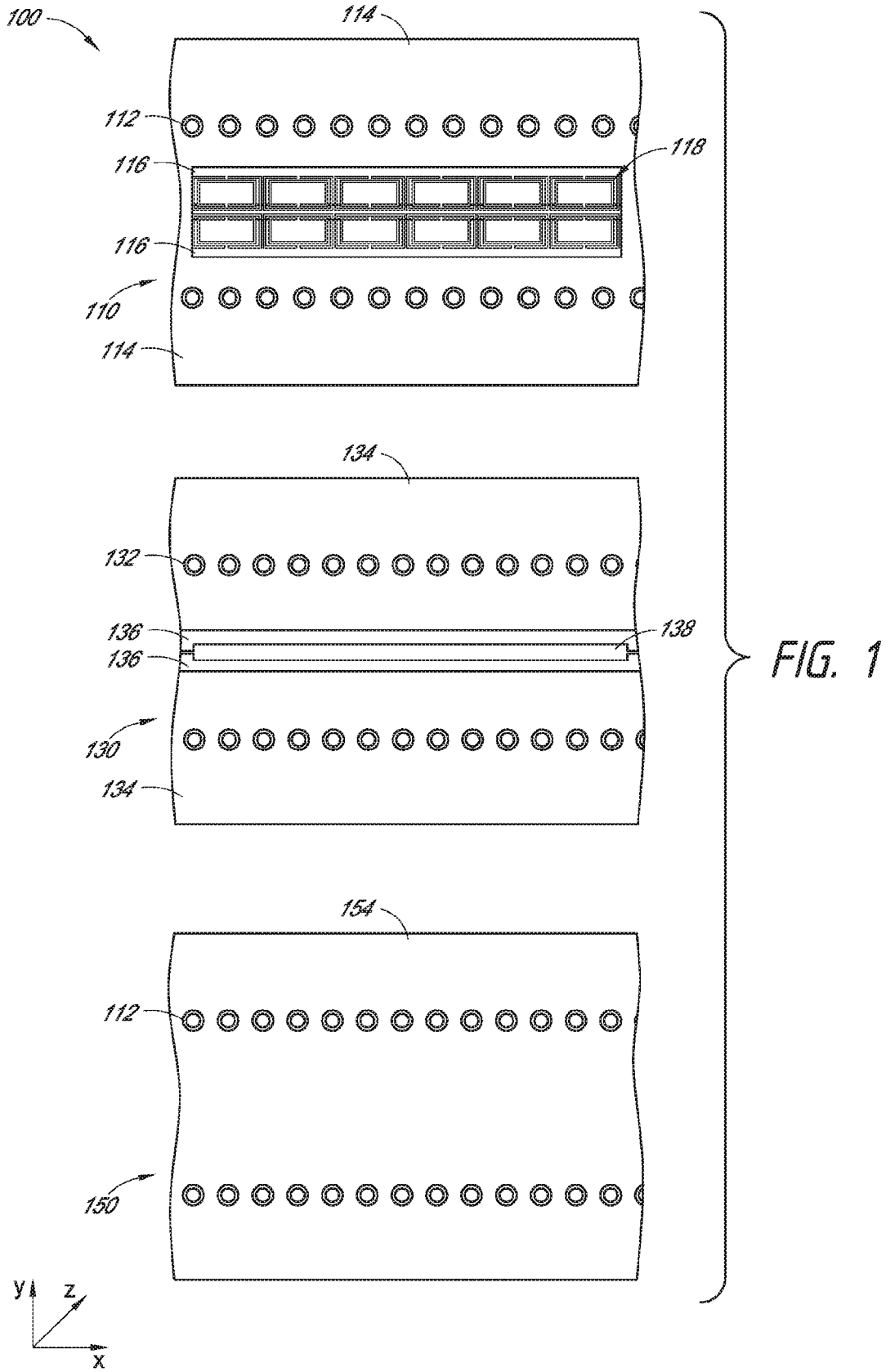
FIG. 1 illustrates a top exploded view of an embodiment of a signal transmission line.

FIG. 1 illustrates a top exploded view of an embodiment of a signal transmission line 100. In some embodiments, the signal transmission line 100 can be a layered structure. As shown in FIG. 1, the signal transmission line 100 can include three layers 110, 130, and 150 comprising at least some conductive material separated by layers comprising mostly dielectric material. FIG. 1 also illustrates an axis corresponding to the signal transmission line 100. The longitudinal direction of the signal transmission line 100 can be parallel to the x-axis and a direction of packaging the three layers together such that three layers are substantially parallel may be parallel to the z-axis. The direction perpendicular to the x-axis and the z-axis can be defined as the y-axis. In some embodiments, the three layers are connected by vias 112 (or through holes). The vias 112 may structurally support the layered structure of the signal transmission line 100 as shown more in detail with respect to FIG. 3. The vias can also electrically connect the layers 110, 130, and 150. The three layers can be packaged in a dielectric body. Accordingly, the three layers may be separated by a dielectric material. In some embodiments, the structural support may be provided by the dielectric material instead of vias. The dielectric material can include flexible thermoplastic resins, such as polyimide or liquid crystal polymer. In one embodiment, a transmission line layer 130 can be arranged in between a patterned structure layer 110 and a grounding conductor layer 150 along the z-axis as illustrated in FIGS. 1-7. In some embodiments, the arrangement of the layers as illustrated in FIG. 1 can enable efficient transmission of high frequency signals across circuits in a mobile device.

The layers 110, 130, and 150 may be perpendicular or substantially perpendicular to the z-axis. In some embodiments, the layers 110, 130, and 150 do not intersect. Further, in some embodiments, the layers 110, 130, and 150 are parallel or substantially parallel with respect to the x-y plane. Accordingly, the layers 110, 130, and 150 may also be parallel or substantially parallel with each other. The layers 110, 130, and 150 may also be rectangular or substantially rectangular. The thickness of the signal transmission line 100 may vary depending on the dielectric body and thickness of the layers. In some embodiments, the thickness of the signal transmission line 100 along the z-axis is less than or equal to 200 μm. In one embodiment, thickness of the signal transmission line 100 is about 50 μm. In some embodiments, the thickness of the signal transmission line 100 can be between less than or equal to about 50 microns and/or greater than or equal to about 12 microns. The width of the signal transmission line 100 along the y-axis may be a function of the thickness. The width of the signal transmission line 100 may be, for example, 10 to 40 times more than the thickness of the signal transmission line 100. In some embodiments, the width of the signal transmission line 100 is about 2 mm. In some embodiments, the length of the signal transmission line 100 is greater than or equal to about 4 cm and/or less than or equal to about 10 cm.

The separation between the layers 110, 130, and 150 may also depend on the thickness of the signal transmission line 100. In some embodiments, the layers are spaced such that the separation between layers 130 and 150 is greater than the separation between layers 130 and 110. Accordingly, the transmission layer 130 may be closer to the patterned structure layer. For example, if the thickness of the signal transmission line 100 is about 125 microns, then the separation between layer 110 and 130 can be about 25 microns and the separation between layer 130 and 150 can be about 100 microns. In some embodiments, the relative distance of the transmission line layer 130 with respect to the patterned structure layer 110 and the grounding conductor layer 150 can be modified to tune the signal transmission line 100.

Transmission Line Layer

Figure 3:
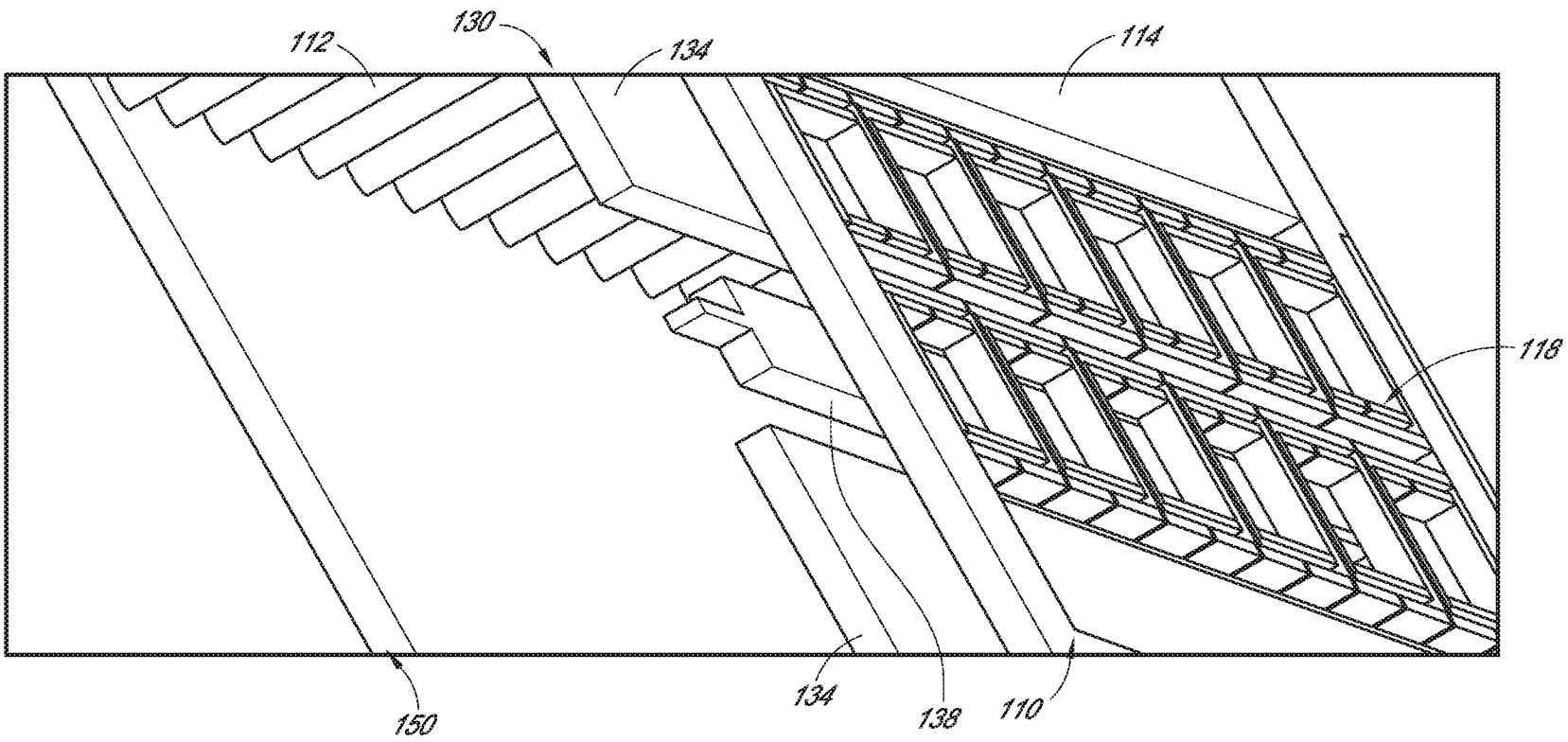
FIG. 3 illustrates an enlarged perspective view of the signal transmission line of FIG. 1.

The transmission line layer 130 can include a signal conductor 138 with co-planar grounding conductors 134 flanking the conductor 138 on both sides as shown in FIG. 1. In some embodiments, the width of the signal conductor 138 can be, for example, about 10 μm to 20 μm. The longitudinal portion of the signal conductor 138 can be parallel to the x-axis. The signal conductor 138 can be narrow outside of the portion overlapping with the patterned structure 118 and then become wider as illustrated in FIGS. 1 and 3. In some embodiments, the wider portion of the signal conductor 138 is three times greater than the narrow portion of the signal conductor 138. The vias 112 can structurally and electrically connect the signal line layer 130 with other layers of the signal transmission line 100. The co-planar grounding conductors can be separated from the signal conductor 138 by a spacing 136. The spacing 136 can be formed of the same dielectric material as the dielectric body. In another embodiment, the spacing 136 can include a different dielectric material than the body dielectric. In an embodiment, the spacing 136 is about the width of the trace 138. In some embodiments, the spacing can include air or vacuum.

The signal conductor 138 may be made of metals with low specific resistance, such as silver or copper. The signal conductor 138 may carry signals of wide range of frequencies between circuits. In some embodiments, the signal conductor 138 can carry high-frequency signals (e.g., frequency greater than 4 GHz). The signal conductor 138 may also be made of flexible material (e.g., flex copper). The co-planar grounding conductors 134 may also include metals with low specific resistance, such as silver or copper. In some embodiments, the co-planar grounding conductors 134 are made of different materials than the signal conductor 138.

Patterned Structure Layer

Figure 2:
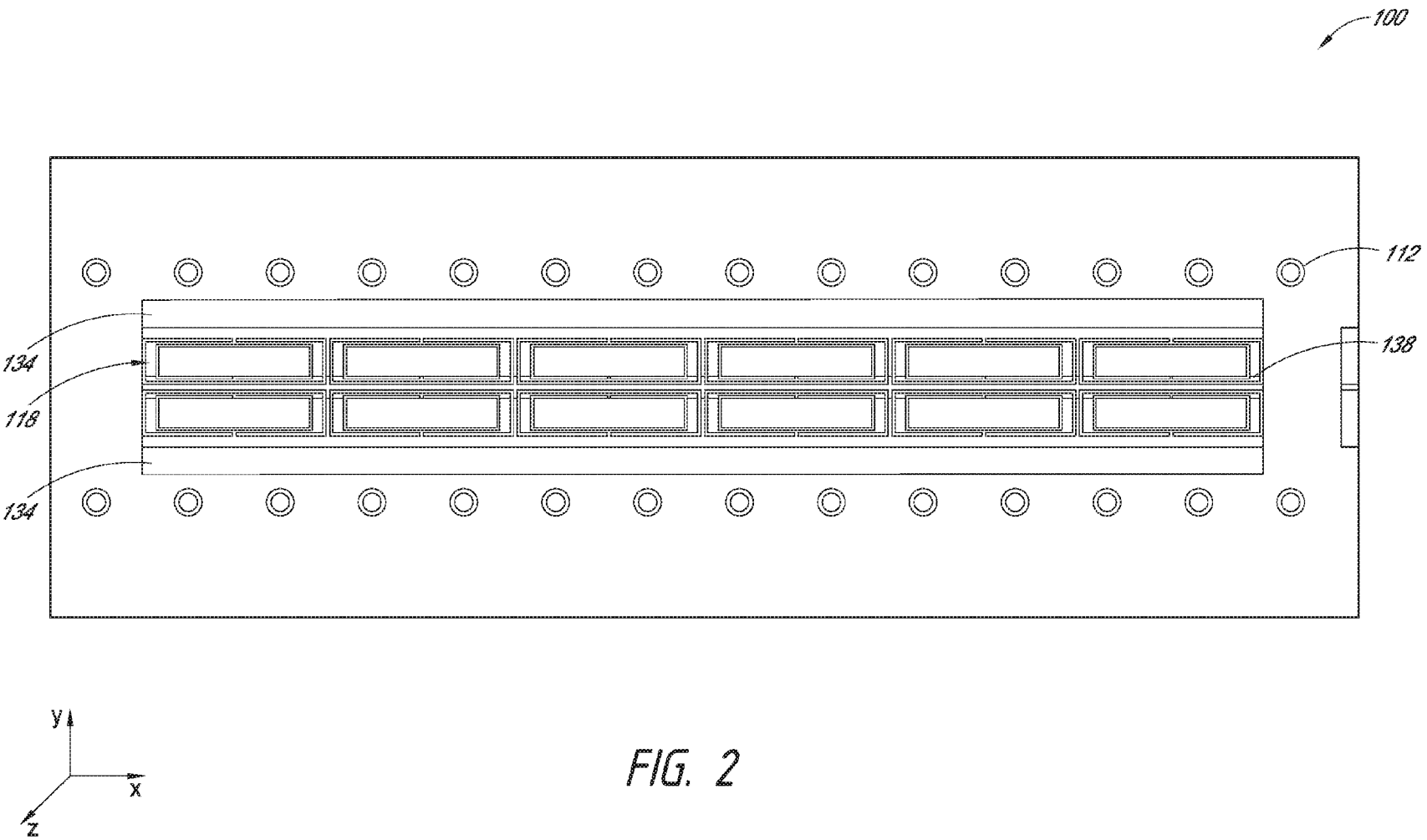
FIG. 2 illustrates a top view of the signal transmission line of FIG. 1.

The patterned structure layer 110 can positioned over the transmission line layer 130 along the z-axis such that at least a portion of the patterned structure layer 110 including a patterned structure 118 can be proximate to the signal conductor 138. The patterned structure layer 110 can include a patterned structure 118 and a grounding conductor 114 as shown in FIG. 1. In one embodiment, the patterned structure 118 can include one or more array of resonators. The resonators can include split ring resonators. In some embodiments, the patterned structure 118 can include a dual array of split ring resonators. The dual array of split ring resonators can be arranged to overlay on top of the signal conductor 138 such that they are offset from the signal conductor 138 as shown in FIG. 2. For example, one array of the split ring resonators may be located on one side of an x-z plane and the second array of the split ring resonators may be located on the other side of the x-z plane. In one embodiment, the x-z plane is perpendicular to the longitudinal axis of the signal conductor 138 and may bisect the signal conductor 138 in equal half. Accordingly, there may be a partial overlap in between the signal conductor 138 and a portion of the split ring resonators. In some embodiments, there is no overlap (as seen from the top) between the patterned structure 118 and the signal conductor 138. In some embodiments, the patterned structure 118 including the dual array of split ring resonators is positioned symmetrically with respect to a center line of the signal conductor 138. FIG. 2 illustrates a top view of an embodiment of a signal transmission line 100. In some embodiments, the patterned structure 118 can also partially overlay on top of the co-planar grounding conductors 134 as shown more in detail with respect to FIG. 3. The patterned structure 118 can be separated from the grounding conductor 114 by a spacing 116. As described above, the spacing 116 can include the dielectric body material. Furthermore, the spacing 116 can also include material other than the dielectric body and may include air or vacuum.

The grounding conductor 114 can include metals with low specific resistance, such as silver or copper. The vias 112 can electrically connect the grounding conductor 114 of the patterned structure layer 110 with the grounding conductors 134 of the signal transmission line 100. In one embodiment, the patterned structure reduces leakage of the electromagnetic field from the signal conductor 138. Accordingly, the position of the patterned structure 118 in the signal transmission line 100 may be optimized with respect to the signal conductor 138 to reduce leakage of the electromagnetic field.

Grounding Conductor Layer

The grounding conductor layer 150 can include a reference conducting sheet 154. The reference conducting sheet 154 can be made of metals with low specific resistance, such as copper or silver.

Vias

Figure 7:
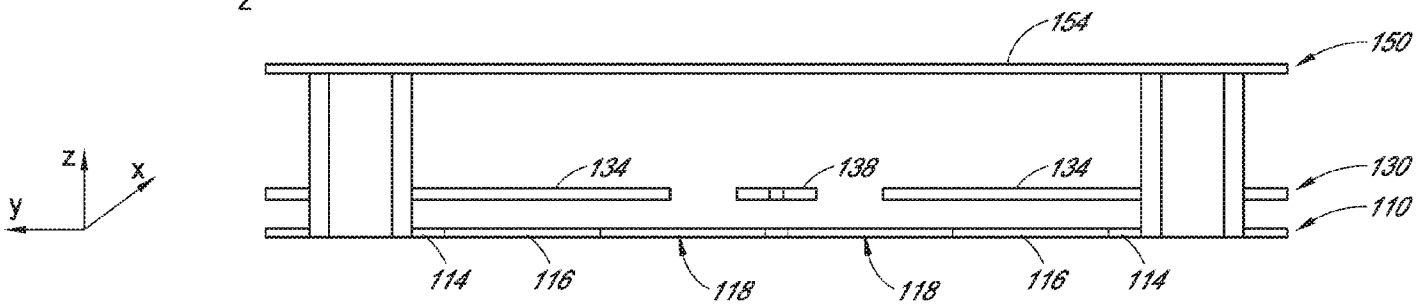
FIG. 7 illustrates an elevation view of the signal transmission line of FIG. 1.

FIG. 3 illustrates an enlarged perspective view of an embodiment of a signal transmission line 100. As described above, the vias 112 can electrically connect the layers of the signal transmission line 100. In some embodiments, the vias may also provide structural integrity between the layers of the signal transmission line 100. As shown in FIG. 3, the vias 112 connect the grounding conductor layer 150 with the transmission line layer 130. The vias may include cylindrical columns and can have an electrical coating for electrically connecting the ground planes 114, 134, and 154. In some embodiments, the vias 112 may include a hollow structure for carrying electrical wires. As described above, the signal transmission line 100 can include a dielectric body that can form the spacing between the layers of the signal transmission line. In one embodiment, the spacing between the three layers may be substantially equal. In other embodiments, the transmission line layer 130 may be closer to the patterned structure layer 110 than the grounding conductor layer 150, as illustrated in FIG. 7.

Split Ring Resonators

Figure 4:
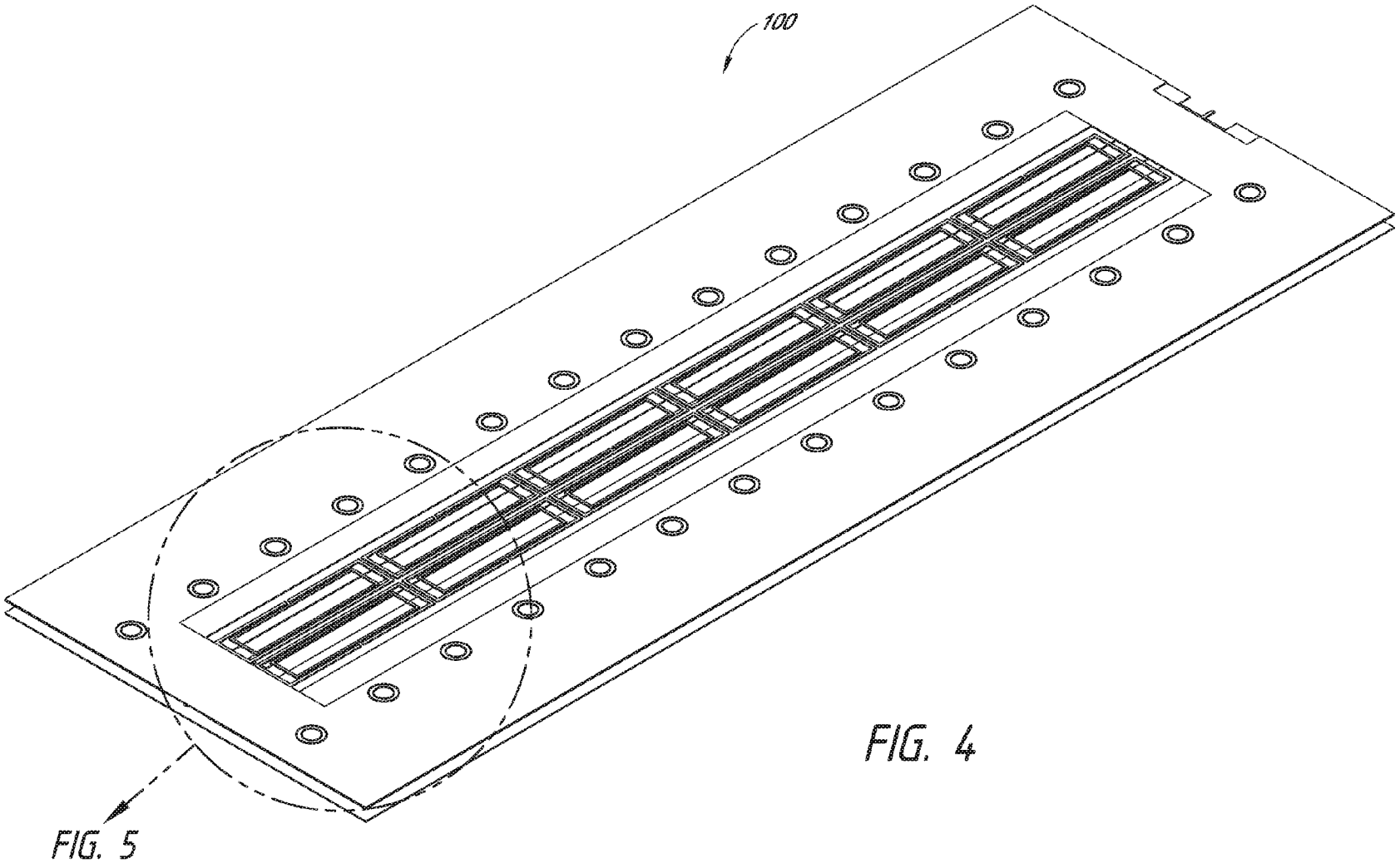
FIG. 4 illustrates a perspective view of the signal transmission line of FIG. 1.
Figure 5:
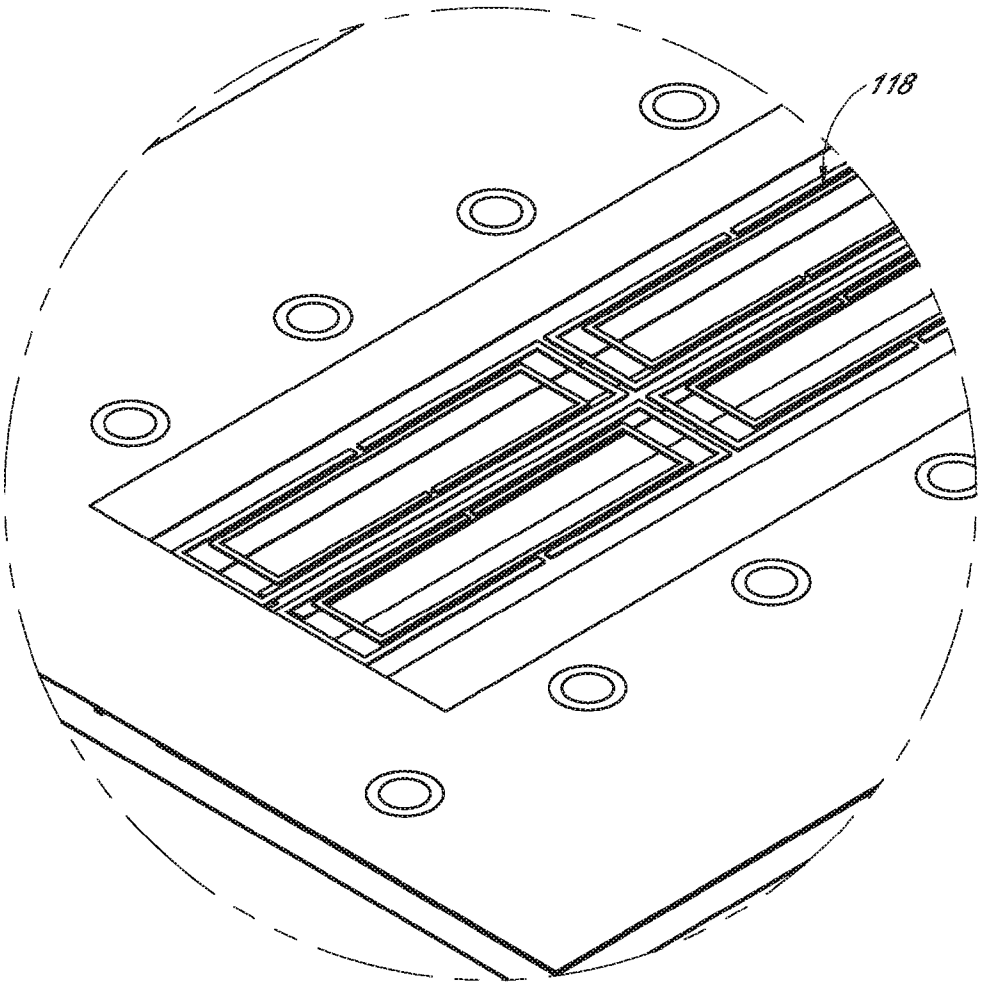
FIG. 5 illustrates an enlarged view of the signal transmission line as shown in FIG. 4.
Figure 6:
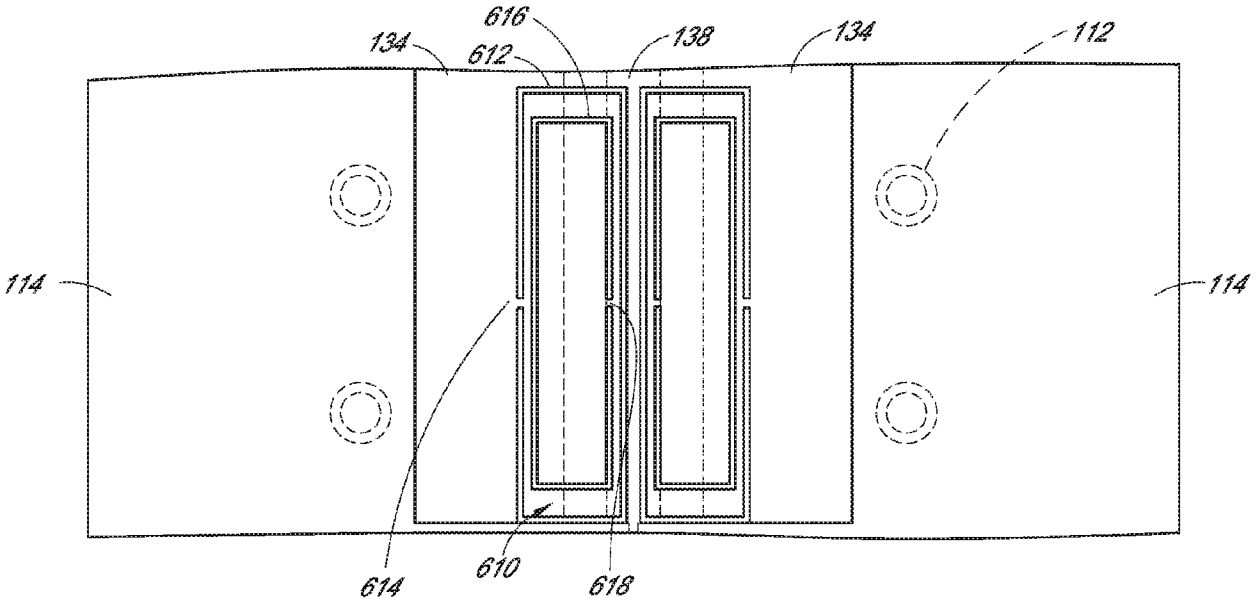
FIG. 6 illustrates a top view of a portion of the signal transmission line of FIG. 1.

FIGS. 4, 5, and 6 further illustrate in detail the patterned structures described above. FIG. 6 illustrates a top view of a portion of the signal transmission line 100 with an embodiment of a split ring resonator 610. As described above, the patterned structures 118 can include an array of split ring resonators 610. In some embodiments, the array of split ring resonators has a periodicity. As illustrated in FIG. 6, the split ring resonators can overlap with the signal conductor 138 and may also partially overlap with the co-planar conductors 134 of the transmission line layer 130 partial overlap A split ring resonator 610 can include an outer ring 612 and an inner ring 616. The outer ring 612 can include a slit 614 on the opposing side of a slit 618 of the inner ring 616. The split ring resonator can include rectangular rings as shown in FIG. 6. In other embodiments, the split resonator can be circular, C-shaped, S-shaped, or omega-shaped. The array of split ring resonators can be one, two, or three dimensional. The split ring resonators can be made from metals. The parameters of the split ring resonators can be varied to optimize transmission in the signal transmission line 100. The array of split resonators may provide improved shielding and reduce leakage of electromagnetic field from the signal conductor 138. In one embodiment, the signal transmission line 100 may include a patterned structure layer 110 on both the top and bottom of the transmission line layer 130 (instead of the grounding conductor layer 150).

Frequency Characteristics

Figure 8:
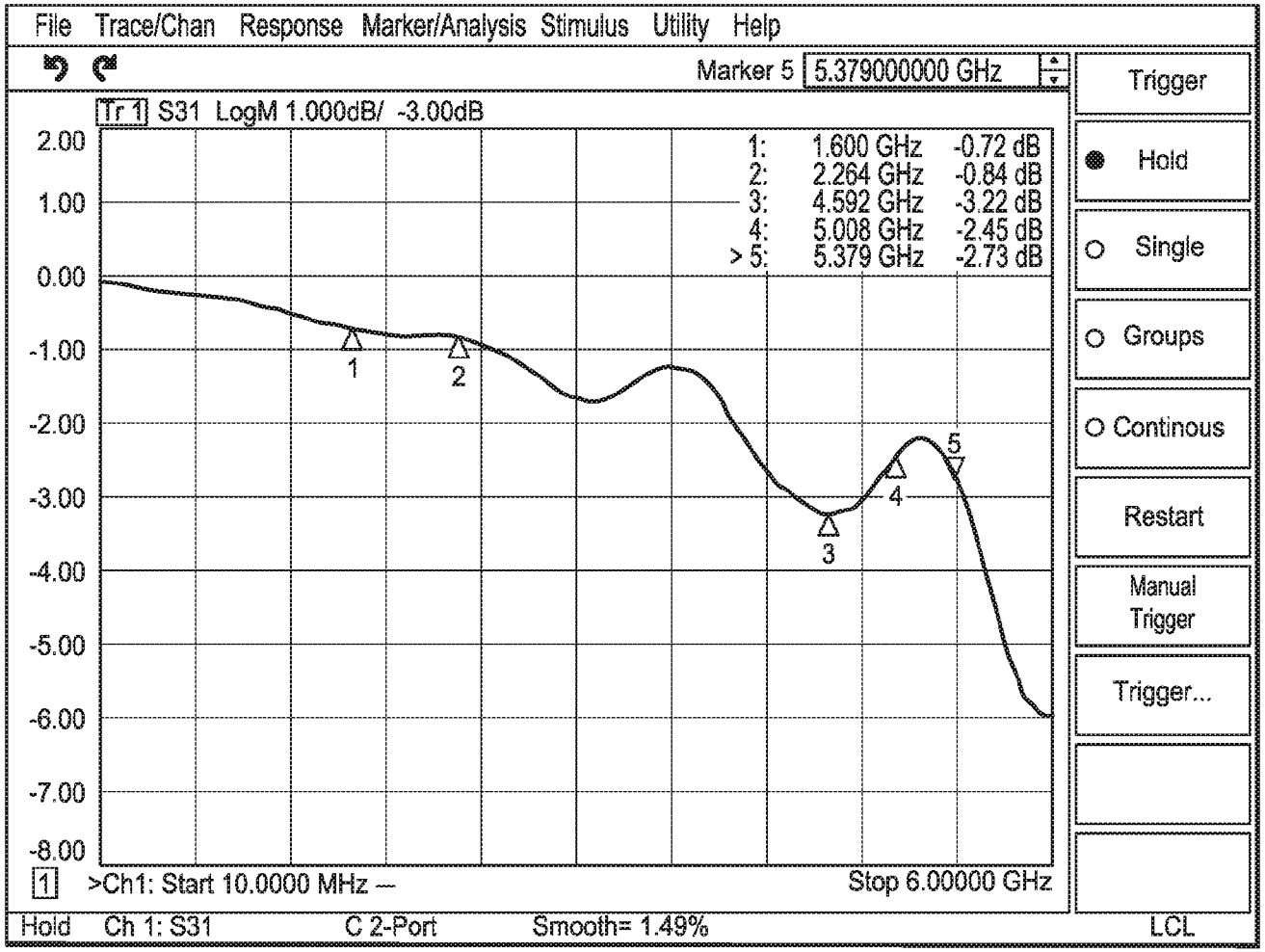
FIG. 8 illustrates frequency performance of an embodiment of a signal transmission line without split ring resonators by plotting s-parameter of the signal transmission line for a broadband signal.
Figure 9:
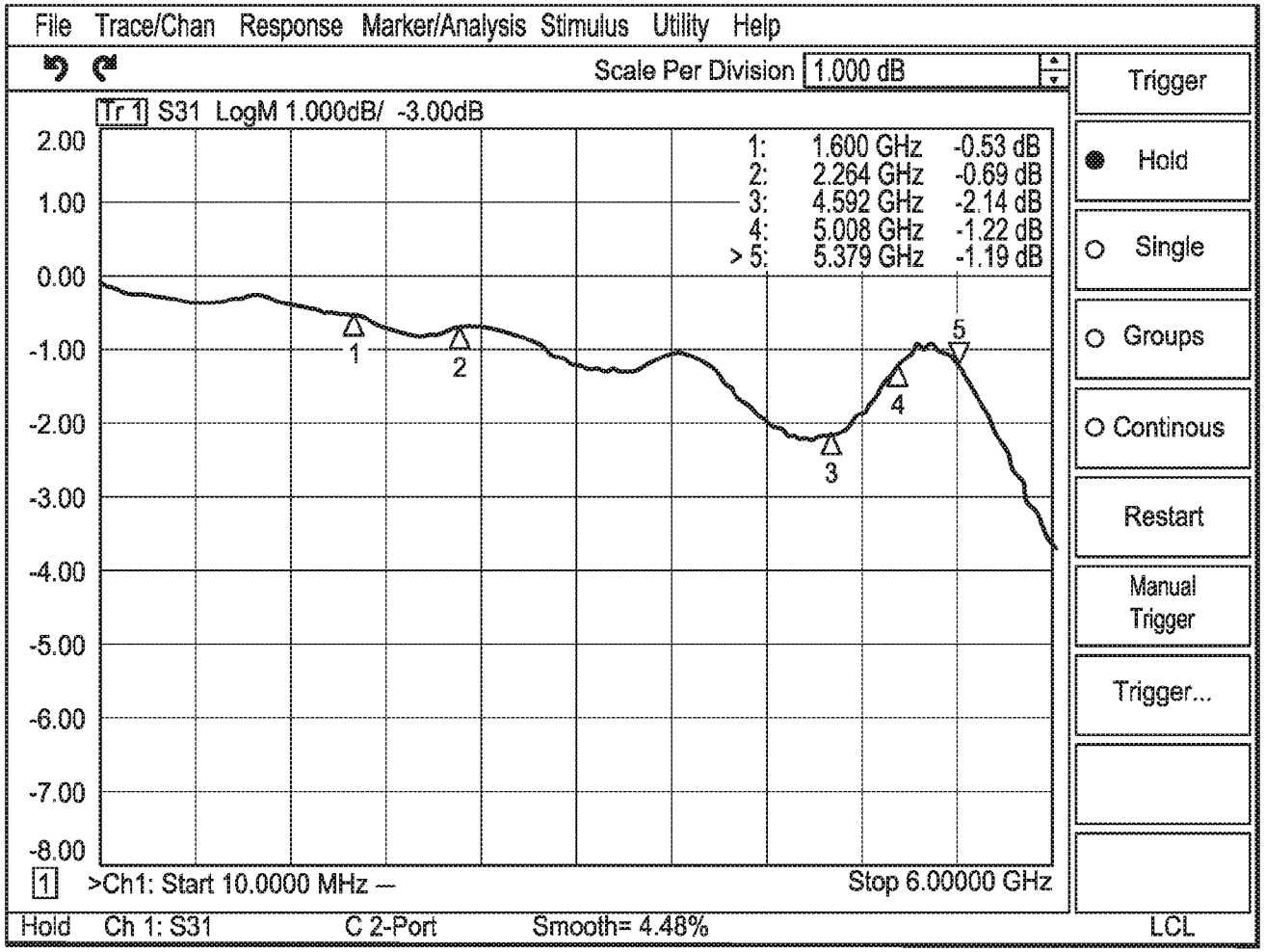
FIG. 9 illustrates frequency performance of an embodiment of a signal transmission line with split ring resonators by plotting s-parameter of the signal transmission line for a broadband signal.

Many electronic devices, including mobile communication devices, may require transmission of electrical signals in a wide range of frequency spectrums depending on the different modes of radio communications. The signal transmission line 100 may need to be optimized for baseband signals. FIG. 8 illustrates a reference frequency performance of a signal transmission line without including the array of split ring resonators. In comparison, FIG. 9 illustrates frequency performance of an embodiment of a signal transmission line 100 including the array of split ring resonators described above. In both FIGS. 8 and 9, the s-parameter of the signal transmission line 100 is plotted for a baseband signal. In some embodiments, the signal transmission line 100 can be optimized for a particular frequency. As shown in FIG. 9, the signal transmission line 100 has a reduced loss near 5 GHz transmission.

TERMINOLOGY

For purposes of summarizing the disclosure, certain aspects, advantages and novel features of certain embodiments have been described herein. It is to be understood that not necessarily all such advantages may be achieved in accordance with any particular embodiment. Thus, the embodiments can be implemented in a manner that achieves or optimizes one advantage or group of advantages as taught herein without necessarily achieving other advantages as may be taught or suggested herein.

Various modifications of the above described embodiments will be readily apparent, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. In addition, the articles "a" and "an" are to be construed to mean "one or more" or "at least one" unless specified otherwise.

Conjunctive language such as the phrase "at least one of X, Y and Z," unless specifically stated otherwise, is otherwise understood with the context as used in general to convey that an item, term, etc. may be either X, Y or Z. Thus, such conjunctive language is not generally intended to imply that certain embodiments require at least one of X, at least one of Y and at least one of Z to each be present.

Additionally, terms such as "above," "below," "top," and "bottom" are used throughout the specification. These terms should not be construed as limiting. Rather, these terms are used relative to the orientations of the applicable figures.

What is claimed is:

1. A signal transmission line comprising:

a signal conductor;

a first array of split ring resonators positioned on a first side of an x-z plane that intersects a longitudinal axis of the signal conductor, wherein the x-z plane splits the signal conductor into a first side and a second side, wherein the x-z plane is substantially perpendicular to the signal conductor;

a second array of split ring resonators positioned on a side opposite from the first side of the x-z plane;

wherein the first array of split ring resonators partially overlaps with the first side of the signal conductor;

wherein the second array of split ring resonators partially overlaps with the second side of the signal conductor; and wherein the first array of split ring resonators and the second array of split ring resonators are positioned in a x-y plane that is substantially parallel to the signal conductor;

a first grounding conductor coplanar with the signal conductor; and an uninterrupted spacing between the signal conductor and the first grounding conductor in a portion where the first array of split ring resonators partially overlaps with the first side of the signal conductor and where the second array of split ring resonators partially overlaps with the second side of the signal conductor.

2. The signal transmission line of claim 1, further comprising:

a dielectric material separating the signal conductor and the first array and the second array of split ring resonators;

a second grounding conductor substantially coplanar with the first and the second arrays of split ring resonators;

a third grounding conductor substantially parallel to the signal conductor; and a plurality of vias configured to electrically connect the first, second, and third grounding conductors.

3. The signal transmission line of claim 1, wherein the first array of split ring resonators is symmetrical to the second array of split ring resonators with respect to the x-z plane.

4. The signal transmission line of claim 1, wherein a thickness of the signal transmission line in the x-z plane including the signal conductor, the first array of split resonators, and the second array of split ring resonators is less than or equal to 200 microns.

5. The signal transmission line of claim 1, wherein a width of the signal transmission line in the x-y plane is greater than or equal to 10 times a thickness of the signal transmission line.

6. The signal transmission line of claim 1, wherein an absolute value of an s-parameter of the signal transmission line is less than or equal to 1 dB for a first range of frequencies.

7. The signal transmission line of claim 1, wherein a first width of the portion of the signal conductor overlapping the first array of split ring resonators is greater than a second width of the signal conductor not overlapping the first array of split ring resonators.

8. The signal transmission line of claim 7, wherein the second width of the portion of the signal conductor not overlapping the first array of split ring resonators is about 10 to 20 microns.

9. The signal transmission line of claim 1, wherein the split ring resonators comprise rectangular split ring resonators.

10. A signal transmission line comprising:

an array of split ring resonators;

a signal conductor comprising two separate sections, a first section and a second section, along a length of the signal conductor, wherein the first section of the signal conductor is inside an area overlapping with the array of split ring resonators, and wherein the second section of the signal conductor is outside the area overlapping with the array of split ring resonators; and an assembly body comprising dielectric material that provides a support structure for at least the split ring resonators and the signal conductor;

wherein a first width of the first section of the signal conductor overlapping in the array of split ring resonators is constant and greater than or equal to three times a second width of the second section of the signal conductor.

11. The signal transmission line of claim 10, wherein the array of split ring resonators partially overlaps with the signal conductor.

12. The signal transmission line of claim 10, further comprising:

a dielectric material separating the signal conductor and the array of split ring resonators;

a first grounding conductor substantially coplanar with the array of split ring resonators;

a second grounding conductor substantially coplanar with the signal conductor;

a third grounding conductor substantially parallel to the signal conductor; and a plurality of vias configured to electrically connect the first, second, and third grounding conductors.

13. The signal transmission line of claim 10, wherein the thickness of the signal transmission line including the assembly body is less than or equal to 200 microns.

14. The signal transmission line of claim 10, wherein a width of the signal transmission line including the assembly body is greater than or equal to 10 times a thickness of the signal transmission line.

15. The signal transmission line of claim 10, wherein an absolute value of an s-parameter of the signal transmission line is less than or equal to 1 dB for a range of frequencies comprising a range of 4 GHz to 7 GHz.

16. The signal transmission line of claim 10, wherein the array of split ring resonators is positioned on a non-intersecting plane with the signal conductor.

17. The signal transmission line of claim 10, wherein the second width of the second section of the signal conductor is about 10 to 20 microns.

18. A signal transmission line comprising:

a signal conductor configured to carry signals of a first range of frequencies, said signal conductor divided into a first section and a second section across a length of the final conductor;

a first array of split ring resonators partially overlapping the signal conductor in the first section of the signal conductor; and a second array of split ring resonators partially overlapping the signal conductor in the first section of the signal conductor;

wherein an absolute value of a s-parameter of the signal transmission line is less than or equal to 1 dB for the first range of frequencies, wherein the first array of split ring resonators is symmetrical to the second array of split ring resonators with respect to a x-z plane that intersects along a longitudinal axis of the signal conductor; and wherein a first width of the signal conductor in the first section where the signal conductor partially overlaps with the first and the second array of split ring resonators is greater than a second width of the signal conductor in the second section.

19. The signal transmission line of claim 18, wherein the signal transmission line is flexible.

20. The signal transmission line of claim 18, wherein the first range of frequencies comprise greater than or equal to 4 GHz and less than or equal to 7 GHz.

21. The signal transmission of claim 18, further comprising:

a dielectric material separating the signal conductor and the first and the second arrays of split ring resonators;

a first grounding conductor substantially coplanar with the first and the second arrays of split ring resonators;

a second grounding conductor substantially coplanar with the signal conductor;

a third grounding conductor substantially parallel to the signal conductor; and a plurality of vias configured to electrically connect the first, second, and third grounding conductors.

22. The signal transmission line of claim 18, wherein the second width of the signal conductor in the second section is about 10 to 20 microns.

* * * * *